United States Patent [19]

Gamberini

[11] Patent Number: 4,615,165

[45] Date of Patent: Oct. 7, 1986

[54] PRODUCT CAPSULING PLANT, PARTICULARLY FOR PHARMACEUTICAL PRODUCTS

[75] Inventor: Ernesto Gamberini, Pianoro, Italy

[73] Assignee: MG 2 S.p.A., Pianoro, Italy

[21] Appl. No.: 656,179

[22] Filed: Sep. 28, 1984

[30] Foreign Application Priority Data

Sep. 30, 1983 [IT] Italy ..... 3573 A/83

[51] Int. Cl.[4] ..... B65B 1/04

[52] U.S. Cl. ..... 53/282; 53/109; 53/381 A

[58] Field of Search ..... 53/281, 282, 381 A, 53/109

[56] References Cited

U.S. PATENT DOCUMENTS

| | | | |
|---|---|---|---|
| 774,378 | 11/1904 | Carter | 53/281 |
| 1,819,936 | 8/1931 | Wilkie et al. | 53/281 X |
| 1,993,716 | 3/1935 | Hanley et al. | 53/281 |
| 2,108,906 | 2/1938 | Speckhart et al. | 53/282 |
| 3,078,629 | 2/1963 | Besemer et al. | 53/282 X |
| 3,273,309 | 9/1966 | Wolf et al. | 53/281 |
| 3,501,894 | 3/1970 | Hayashi et al. | 53/281 |
| 3,527,015 | 9/1970 | Aronson et al. | 53/282 X |
| 3,534,526 | 10/1970 | Hostetler et al. | 53/282 |
| 3,601,954 | 8/1971 | Aronson | 53/282 |
| 3,675,390 | 7/1972 | Austin | 53/282 |
| 3,978,640 | 9/1976 | Crossley et al. | 53/282 X |
| 4,006,578 | 2/1977 | Gamberini | 53/282 |
| 4,089,152 | 5/1978 | Zanosi | 53/281 |
| 4,091,600 | 5/1978 | Itoh | 53/381 A X |
| 4,163,354 | 8/1979 | Austin | 53/282 X |

*Primary Examiner*—J. Howard Flint, Jr.
*Attorney, Agent, or Firm*—Michael N. Meller

[57] ABSTRACT

Process and plant for capsuling products, particularly pharmaceutical products, using capsules each consisting of a bottom, containing the product itself, and a removable top, whereby each bottom, once separated from the respective top, is fed by a conveying member through a number of filling and control stations to a closing device where each bottom is fitted with the respective top supplied to the closing device along a separate route running through a parking device.

7 Claims, 6 Drawing Figures

PRODUCT CAPSULING PLANT, PARTICULARLY FOR PHARMACEUTICAL PRODUCTS

BACKGROUND OF THE INVENTION

The present invention relates to a plant for implementing a product capsuling process, particularly for pharmaceutical products.

According to current capsuling processes, closed capsules, each comprising a top and bottom, are set up vertically one after the other with the top facing upwards. The top is then taken off the bottom and deposited, together with the latter, on a conveying member. Each bottom, still accompanied by the respective top, is then fed by the conveying member through a number of operating stations, where it is filled with powder, paste, tablets, granules or liquid. Finally, each top is put back onto the respective bottom and the capsule so formed is first closed by engaging the top and bottom and then expelled towards a packing machine.

The aforementioned known capsuling process proves highly complex in that it involves feeding through the entire plant an active member, consisting of the bottom of each capsule, and a passive member, consisting of the respective top, which only comes into play at the initial opening and final capsule-closing stages.

SUMMARY OF THE INVENTION

The aim of the present invention is to provide a plant for implementing a capsuling process designed to overcome the aforementioned drawback.

With this aim in view, the present invention relates to a plant for implementing a process for capsuling products, particularly pharmaceutical products, using capsules, each comprising a bottom, containing the product itself, and a removable top for closing the bottom, characterized by the fact that it comprises the following stages:

feeding, by first conveying means, each bottom, separated from the respective top by separating means, along a first route extending through operating stations comprising at least a station for feeding or metering the said product inside the said bottom and a closing station;

feeding each top, by second conveying means, along a second route, separate from the first route and extending between the separating means and the said closing station and outside each feeding or metering station; the first and second routes being of the same length; and joining, by fastening means, each bottom to the respective top at the said closing station.

As such, the present invention relates to a plant for capsuling products, particularly pharmaceutical products, using capsules, each comprising a bottom, containing the product itself, and a removable top for closing the bottom, characterized by the fact that it comprises, in due combination, means for separating each bottom from the corresponding top; operating stations comprising at least a station for feeding or metering the product inside the bottom and a station for closing the said bottom; first conveying means for feeding each bottom along a given first route extending through the operating stations; second conveying means for feeding each top between the said separating means and the said closing station, along a given second route extending out side each feeding or metering station and being of the same length as the first route; and fastening means at the said closing station for joining each bottom to the respective said top.

BRIEF DESCRIPTION OF THE DRAWINGS

A non-limiting arrangement of the present invention will now be described with reference to the attached drawings in which.

DETAILED DESCRIPTION OF THE INVENTION

Figure 1:
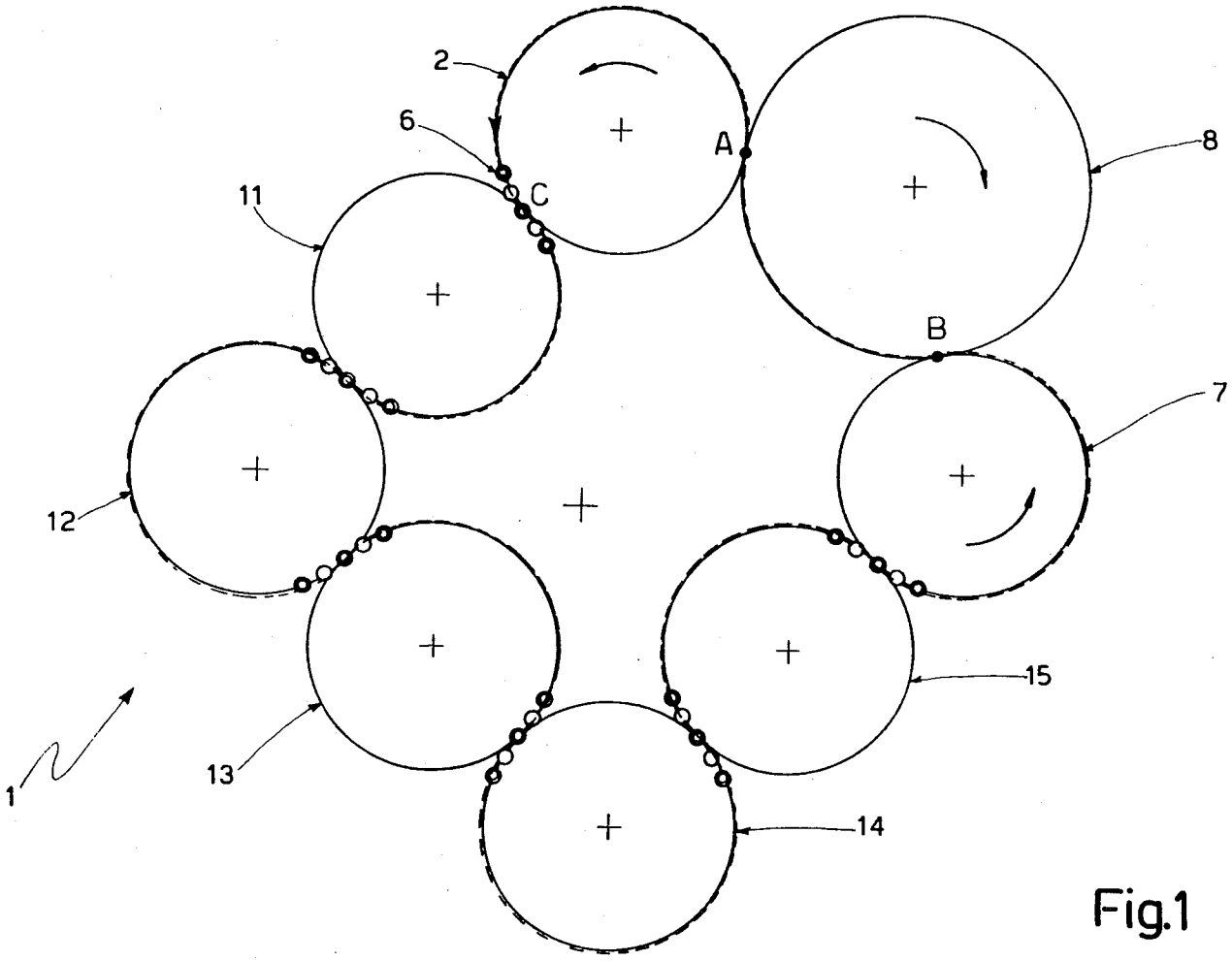
FIG. 1 shows a schematic representation of a plant for implementing the process covered by the present invention.

FIG. 1 shows a schematic representation of a plant, indicated as a whole by 1, and comprising a device 2 for feeding a number of capsules 3 (see FIG. 2), consisting of a top 4 and bottom 5, onto a conveying member 6. The latter extends through the entire plant 1, i.e. through a plurality of operating stations comprising a final operation station consisting of device 7 for closing capsules 3. Device 7 is assigned a parking device 8 designed to receive tops 4 from device 2 and to feed them to closing device 7.

In the example shown, the operating stations comprise a number of devices 11 to 15, each comprising, like devices 2, 7 and 8, a respective rotary portion along which is supported a portion of conveying member 6, which is a serpentine closed element as shown by the dotted line in FIG. 1. Conveying member 6 comprises a plurality of rings 16 connected together, each ring 16 being designed to house a small cylinder 17 (FIG. 5) engaged by a respective bottom 5. Cylinder 17 is hollow with an intermediate annular ridge 18 inside, on which the lower end of bottom 5 abuts.

Devices 11 to 15 are metering and control devices which, for the sake of simplicity, will not be described herein.

These known devices are located between feed device 2 and closing device 7 and are traversed, one after another, by conveying member 6, which travels through feed device 2 and back by way of closing device 7 and parking device 8.

It should be pointed out, in connection with FIG. 1, that the part of conveying member 6 winding around sections of devices 2, 7 and 11 to 15 is much shorter than shown in the diagram and is generally less than twice the circumference of the rotary part on parking device 8.

In more detail, as shown in FIG. 1, the rotary part of parking device 8 is tangent with the rotary parts of devices 2 and 7 at points A and B respectively, whereas device 2 is tangent with device 11 at point C. By appropriately selecting the diameter of device 8 and inserting to a greater or lesser degree the rotary part on the device 8 between the rotary parts of devices 2 and 7, so as to enable appropriate positioning of points A and B, a first route extending through devices 11 to 7 along conveying member 6 between points C and B can be made to match a second route extending outside conveying member 6 and comprising segments C-A, A-A (a full turn of the rotary part on device 8) and A-B.

Figure 2:
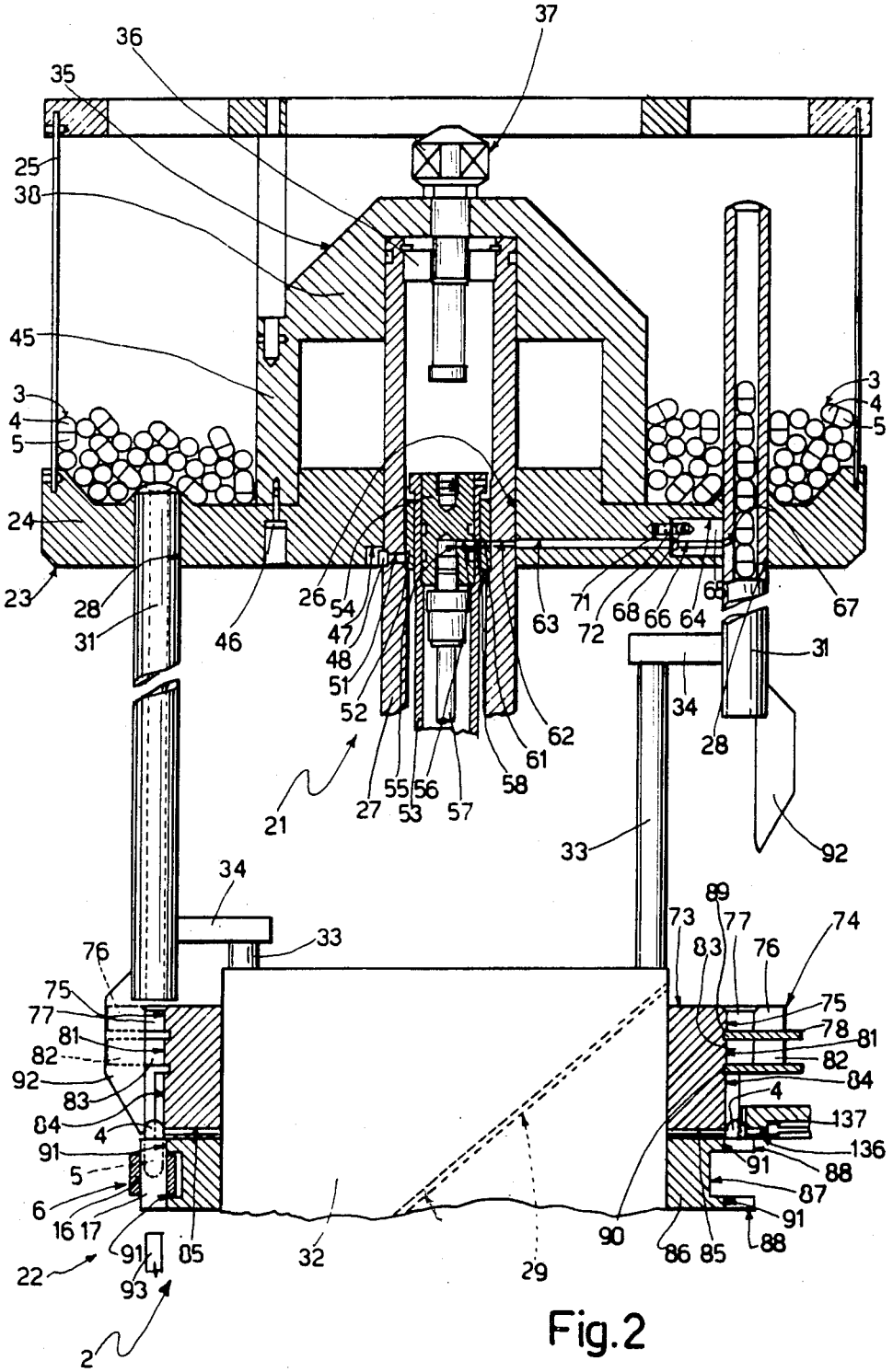
FIG. 2 shows a section of a first device on the plant of FIG. 1.

As shown in FIG. 2, device 2 has a top part 21 and a bottom part 22. Top part 21 comprises a rotary feedbox 23 containing a number of capsules 3 and defined by an annular base wall 24 and a cylindrical side wall 25. Base wall 24 has a vertical centre hole 26 engaged by a rotary, hollow drive shaft 27 designed to turn feedbox 23. Around a peripheral rim of wall 24, provision is made for a plurality of through holes 28 parallel with the axis of hole 26 and each engaged in an auxiliary slidable manner by a respective tubular sleeve 31. Each sleeve 31 turns with feedbox 23 around the axis of the latter and is moved back and forth in relation to the feedbox by a vertical cam 29 formed inside a rotary cylindrical element 32 on bottom part 22. Cam 29 cooperates with a number of vertical tappet rods 33 mounted in an axially slidable manner on element 32 and each made integral with a respective sleeve 31 by means of side bracket 34.

Shaft 27 has its bottom end (not shown) fitted on element 32 and its top end located inside and connected to feedbox 23 by way of a cup-shaped cylindrical body 35 having its concave side facing downwards. The top end of shaft 27 is made axially integral with body 35 by a coupling 36, the coupling 36 axially integral with and mounted inside shaft 27 and being engaged by a threaded pin 37 fitted through a top wall 38 of body 35.

Body 35 also has a cylindrical side wall 45 extending downwards from wall 38 and connected to wall 24 on the feedbox by a plurality of screws 46.

At the bottom end of hole 26 in wall 24, provision is made for a recess 47 through which a screw 48 may be screwed into a threaded radial hole 51 in shaft 27. At hole 26, shaft 27 houses, by means of bushing 52, the top end of a tubular element 53 extending downwards inside shaft 27. The element 53 is supported by a fixed portion (not shown) of device 2 so as not to turn with shaft 27. The top end of element 53 is closed off by a cap 54 having a dead axial hole 55 at the bottom communicating with radial hole 56. Hole 55 has a threaded bottom section engaged by one end of duct 57 constituting the end of a compressed air supply circuit.

Hole 56 is coaxial with a radial through hole 58 formed in tubular element 53 and with a radial through hole 61 formed in bushing 52. At hole 56, shaft 27 has a plurality of radial through holes 62 equal in number to sleeves 31. As shaft 27 turns round, holes 62 communicate, one after the other, with hole 56 by means of holes 58 and 61.

On base wall 24, provision is made for a plurality of radial holes 63 coaxial with holes 62 and equal in number to sleeves 31. Between holes 28 and holes 63, provision is made in base wall 24 for respective cavities 64 each engaged by a respective plastic sealing bushing 65 having a through hole 66 coaxial with hole 63. Each hole 66 communicates with the inside of the respective sleeve 31, when the latter is in the topmost axial slide position, by means of a through hole 67 formed in the wall of sleeve 31. Bushing 65 also has a dead hole 68 coaxial with and facing a dead hole 71 formed in wall 24 opening into cavity 64 and parallel with hole 63. Holes 68 and 71 house opposite ends of a spring 72 designed to press bushing 65 against respective sleeve 31.

On element 32 is fitted a coupling 73, from the top end of which extends a first flange 74 having a plurality of radial slots 75 equal in number to sleeves 31. In more detail, each slot 75 has a radial end section 76, of constant width at least equal to the outside diameter of bottoms 5, and an inner section 77 which is circular in shape when viewed from above, slightly larger in diameter than the width of section 76 and smaller in diameter than the outside diameter of tops 4. Underneath and parallel with flange 74, a second flange 78 extends from coupling 73, the flange 78 also having a plurality of radial slots 81 equal in number and located next to slots 75. Slots 81 also have a radial end section 82 of constant width and a circular inner section 83 coaxial with section 77 of slot 75. Below flange 78, on the cylindrical outer surface of coupling 73, provision is made for a number of semicircularsection axial slots 84 coaxial with slots 75 and 81 and each communicating with a respective hole 85 formed radially through coupling 73 and constituting the end section of an air-intake circuit.

Figure 6:
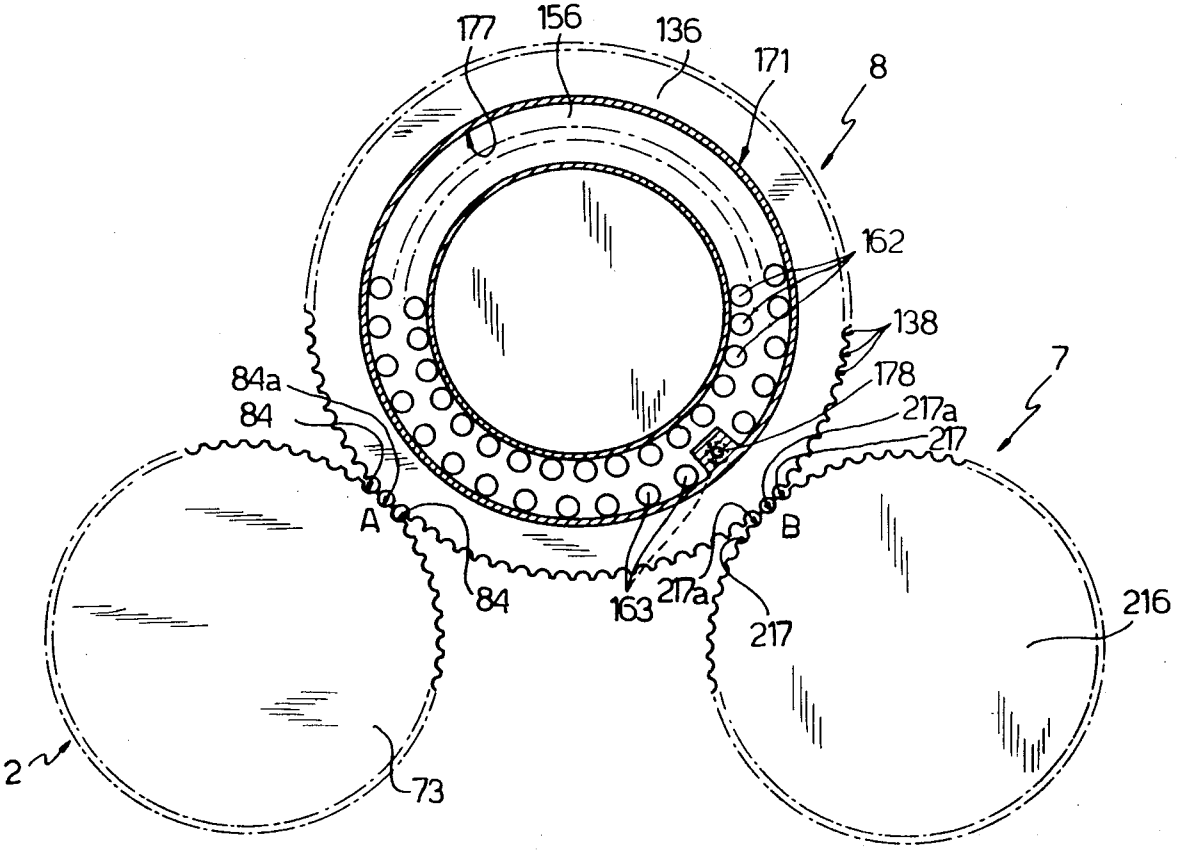
FIG. 6 shows a partial section, with parts removed for clarity, of a portion of the of FIG. 1 plant.

As shown in FIG. 6, on the outer surface of coupling 73, provision is made for a second plurality of slots **84*a*, identical to slots 84 but without holes 85. Each slot 84*a* is located between two adjacent slots 84**.

Below coupling 73, element 32 is fitted with a second coupling 86 constituting the rotary part of device 2 along part of which winds conveying member 6. Alongs its cylindrical outer surface, coupling 86 has an annular cavity 87 engaged by a portion of conveying member 6 and limited at the top and bottom by two flanges 86 each having a respective plurality of radial slots 91 essentially semicircular in shape when viewed from above. Slots 91 are engaged on opposite sides by cylinder 17 on conveying member 6. From the bottom end of each sleeve 31 extends downwards a respective appendix 92 designed to engage alternately a respective pair of end sections 76 and 82. The spaces between flanges 74 and 78 and respectively between flange 78 and slots 84 are partially engaged by respective fixed blades 89 and 90 extending as far as respective peripheral portions of coupling 73. In known manner, not described herein for simplicity, blades 89 and 90 cooperate with slots 75 and 81 and appendixes 92 in such a manner as to guide capsules 3, as they drop down towards respective cylinders 17, and to position them, as they fall, so that bottom 5 faces downwards.

Below conveying member 6, at point C on the periphery of coupling 86, provision is made for a duct 93 communicating selectively with the bottom end of cylinders 17 and constitutng the bottom of an air intake circuit.

Figure 3:
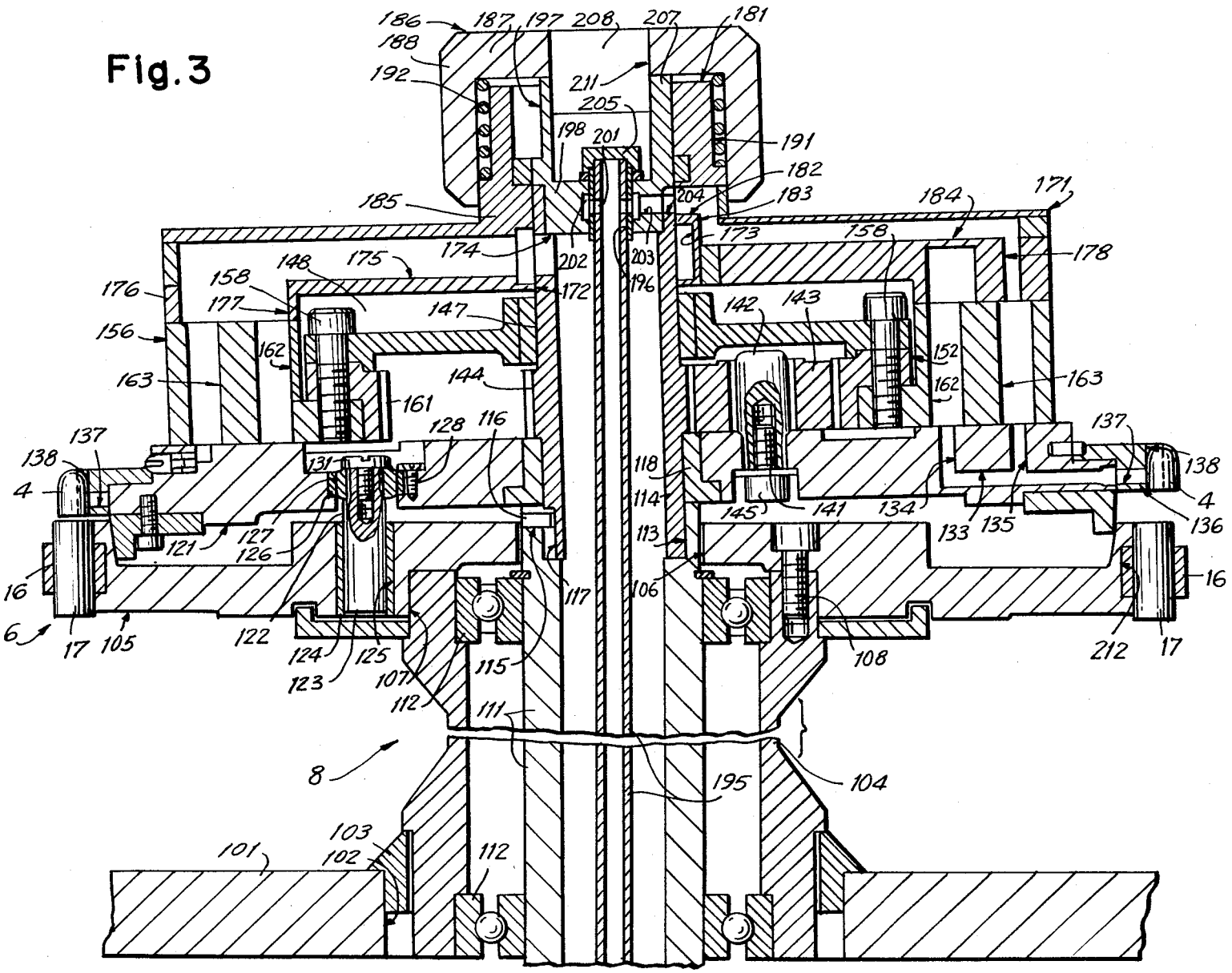
FIG. 3 shows a section of a second device on the plant of FIG. 1.

As shown in FIG. 3, parking device 8 comprises a base wall 101 having a through hole 102 engaged, in rotary manner via ring nut 103, by a hollow drive shaft 104 supporting, over wall 101, a rotary disc 105 constituting the rotary part of parking device 8 along part of which winds conveying member 6. In more detail, disc 105 is provided with a central through hole 106 the flared bottom section 107 of which houses the top end of shaft 104, which is secured to disc 105 by screws 108 and is coaxial with both disc 105 and hole 106.

Shaft 104 houses a fixed, coaxial, hollow cylinder 111 connected to shaft 104 by means of bearings 112. Cylinder 111 extends upwards beyond the top end of shaft 104 and beyond hole 106, at which cylinder 111 presents an annular recess 113 having its axis inclined in relation to that of cylinder 111 and in which is seated the bottom end of a fixed bushing 114 coaxial with the recess 113. A top end portion of cylinder 111 has a radial hole 115 housing a pin 116, one end of which engages an axial slot 117 on the bottom end of bushing 114 for locking the latter in relation to cylinder 111.

At the bottom, bush 114 supports, by means of bushing 118, a rotary disc 121 which is coaxial with bushing 114 and therefore inclined in relation to disc 105. Disc 121 is connected to disc 105 by means of an articulated ball coupling. For this purpose, disc 121 has a through hole 122 parallel with bushing 114 and engaged by the top end of pin 123, the bottom end of which is housed, by means of bushing 124, in a through hole 125 formed in disc 105 and having its axis parallel with that of shaft 104. The top end of pin 123 is fitted, by means of axial screw 131, with a wheel 126 engaging a spherical recess in a ring 127 secured inside hole 122 by axial screw 128. The aforementioned coupling allows disc 121 to turn together with disc 105, but around a center located along the axis of bushing 114.

Disc 121 is provided with a plurality of radial dead holes 133, the outer end of which communicates externally and the inner end of which communicates with a respective hole 134 extending upwards and having its axis parallel with that of bushing 114. From a mid-section of hole 133 there extends upwards a further hole 135 havings its axis parallel with that of hole 134. On the outer cylindrical surface of disc 121 is fitted an integral annular element 136 having a plurality of radial through holes 137 each communicating with a respective hole 133. At the outer end of each hole 137, provision is made, on the outer cylindrical surface of element 136, for a respective slot 138 having its longitudinal axis parallel with the axis of bushing 114 and being engaged by a respective top 4.

As shown in FIG. 6, the distance between two adjacent slots 138 is equal to the distance between two adjacent slots 84 and **84*a* and, consequently, to half the distance between two adjacent cylinders 17 on conveying member 6. Close to bushing 118, disc 121 has an axial through hole 141 engaged by a pin 142 secured to disc 121 by screw 145 and supporting, in idle manner at the top of disc 121, a gear 143 which meshes with a toothed portion 144 on busing 114 over its own portion inside bushing 118**.

As shown in FIG. 3, over toothed portion 144, bushing 114 supports, by means of bush 147, a rotary disc 148 to which are connected, by means of a plurality of through pins 158, a bottom annular element 152 and an outer annular element 156, the latter constituting a rotary air distributor and both being coaxial and integral with disc 148. On the inner cylindrical surface of element 152, provision is made for teeth 161 meshing with gear 143 and constituting the outer ring gear of an epicyclic train, the fixed sun gear of which consists of toothed portion 144 and the carrier of which consists of disc 121 which, in this manner, turns annular element 156 at a speed greater than its own.

As explained in more detail later on in connection with the operation of device 8, the epicyclic train is sized in such a manner that the speed of annular element 156 equals that of the rotary part on device 2, consisting of coupling 83, as well as that of coupling 73. Annular element 156 has two rings of through holes, 162 and 163, equal in number, parallel with the axis of bushing 114 and offset by half the center distance in relation to one another. As shown in detail in FIG. 6, the mid-line of the segment joining the longitudinal axes of two adjacent holes 162 intersects the axis of a hole 163. The diameter of the locus circumference of the axes of holes 162 equals that of the axes of holes 134, and the diameter of the locus circumference of the axes of holes 163 equals that of the axes of holes 135.

As disc 121 and element 156 rotate at different speeds, each hole 133 communicates alternately, by means of holes 134 and 135, with holes 162 and 163, in that, when a hole 162 communicates with a hole 134, none of holes 163 communicate with the relative hole 135, whereas when a hole 163 communicates with hole 135, none of holes 162 communicate with the relative hole 134.

For the number of holes 162 and 163, refer to the operating description of device 8.

As shown in FIG. 3, over bush 147, bushing 114 is fitted with an annular element 171 having an axial center hole 172 engaged by a corresponding portion of bushing 114. At hole 172, provision is made for an annular cavity 173 communicating with the inside of bushing 114 by means of a radial through hole 174 in the latter. Cavity 173 communicates with six radial holes 175 on element 171. The latter also presents a peripheral annular ridge 176 extending downwards and facing element 156. Along ridge 176, provision is made for an annular cavity 177 communicating with holes 175 and being, along practically the whole of ridge 176, of such constant width as to enable cavity 177 to communicate simultaneously with most of holes 162 and 163. Along one portion, cavity 177 is narrower, so as to enable cavity 177 to communicate solely with the holes 162 relative to that portion. Outside this narrower portion, provision is made, through element 171, for an axial hole 178 open at the bottom and coaxial with whichever of holes 163 faces hole 178 during rotation of element 156.

From the top surface of element 171, corresponding with hole 172, a coupling 181 extends coaxially upwards, this coupling being provided with a radial hole 182 communicating with hole 178 via hole 183, formed in coupling 181 with its axis parallel with the axis of the latter, and via radial hole 184 in element 171. Coupling 181 presents an externally threaded bottom portion 185 onto which is screwed a body 186 in the shape of an upsidedown cup. The body 186 has a top wall 187 and a cylindrical side wall 188 threaded internally and connected to portion 185. Over portion 185, on the cylindrical outer surface of coupling 181, provision is made for an annular recess 191 housing a helical spring 192 the top end of which is compressed contacting the bottom surface of wall 187.

The six holes 175 and hole 184 are evenly distributed round the axis of element 171.

Figure 4:
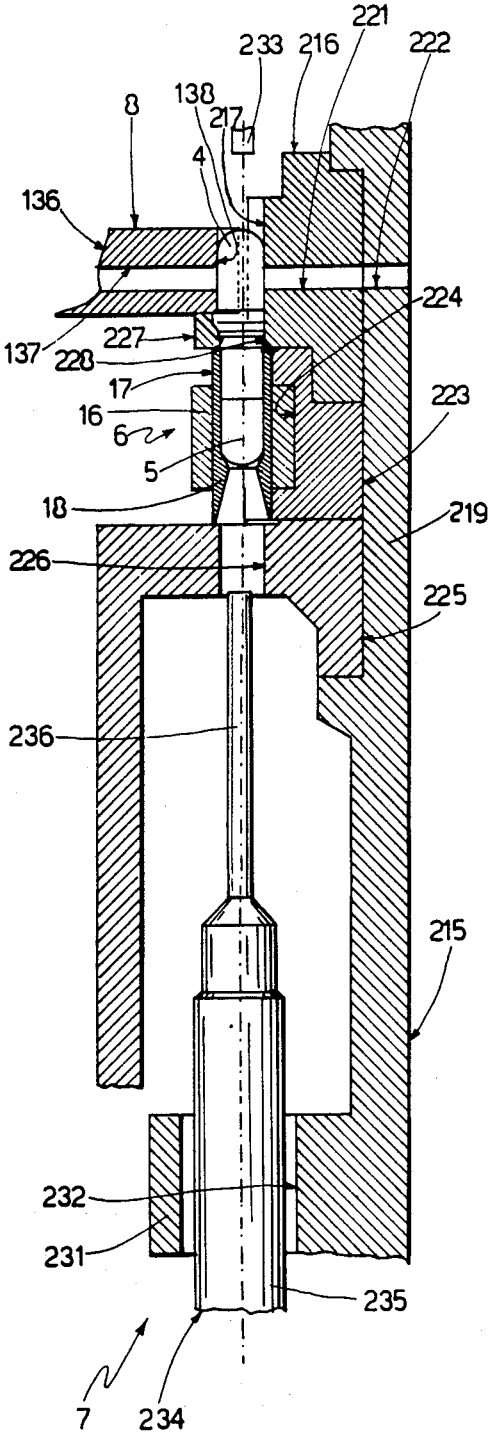
FIGS. 4 and 5 show two partial sections of a third device on the plant of FIG. 1 in two different operating stages.
Figure 5:
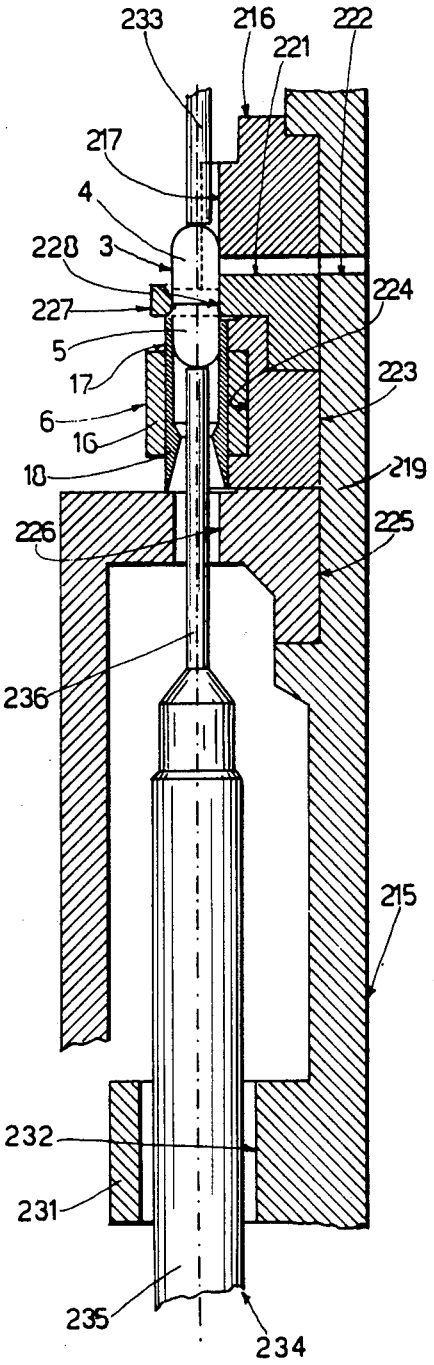

Cylinder 111 houses a second hollow, coaxial cylinder 195 extending upwards beyond the top end of bushing 114, the cylinder 195 being fixed and constituting the end section of a compressed air supply circuit. Cylinder 111 also constitutes the end of an air intake circuit communicating, through the inside of bushing 114, with the inside of holes 175 and 177. The top end of cylinder 195 engages a center through hole 196 in a cylindrical element 197 having a portion 198 engaging the top end of bushing 114. The top end of cylinder 195 presents a diametrical hole 201 communicating, via an annular cavity 202 on element 197 next to hole 196, with a radial hole 203 on element 197. Hole 201 is coaxial with hole 203 and communicates with hole 182 via hole 204 at the top end of bushing 114. The top end of cylinder 105 is closed airtight by a cap 205 having a cylindrical portion extending downwards and engaging hole 196. Needless to say, along this cylindrical portion, provision is made for a diametrical hole connecting hole 201 and cavity 202. From portion 198, a coupling 207 extends upwards inside coupling 181, the bottom section of the coupling 207 housing the head of cap 205 engaging the top end of cylinder 195, and the top section being threaded internally for engaging a cylindrical cap 207 threaded externally and engaging a through hole 211 in the center of wall 187 on body 186. On its cylindrical outer surface, disc 105 has an annular recess 212 engaged by conveying member 6. Annular element 136 may be replaced with a similar element, but with hole 137 possibly of different diameter and slot 138 of different width, for adapting to the shape of tops 4. As shown in FIGS. 4 and 5, closing device 7 comprises a cylindrical body 215 rotated about its own vertical axis by actuating means not shown. Body 215 comprises a side wall 219, a top portion of which is fitted with an annular element 216. On a cylindrical outer surface of element 216, provision is made for a plurality of slots 217 each having its longitudinal axis parallel with the axis of element 216 itself. Next to each slot 217 on element 216, provision is made for a respective radial through hole 221 coaxial with a respective radial hole 222 through wall 219. Each hole 222 constitutes the end section of a pneumatic circuit communicating selectively, in known manner, during rotation of body 215, with an intake device and a blowing device not shown.

As shown in FIG. 6, between each pair of slots 217, provision is made for a slot 217*a* without hole 221. The distance between two adjacent slots 217 is equal to that between slots 84, whereas the distance between one slot 217 and each adjacent slot 217*a* is equal to the center distance of slots 138.

Below element 216, wall 219 is fitted with a second annular element 223 which turns together with element 216 and constitutes the rotary part of device 7, along part of which conveying member 6 winds. On the outer surface of annular element 223, provision is made for an annular groove 224 engaged by the conveying member 6, to be more exact, a portion of ring 16. Below element 223, wall 219 is fitted with a third annular element 225 having a plurality of through holes 226 each coaxial with a respective slot 217. From a bottom portion of element 216, an annular appendix 227 extends outwards with a plurality of through holes 228 each coaxial with a respective slot 217. Each hole 228 is coaxial with a respective hole 226 and a respective slot 217. Each cylinder 217 is located between appendix 227 and element 225, and is coaxial simultaneously with a hole 228 and a hole 226. At the bottom, wall 219 has an annular outer flange 231 having a plurality of through holes 232 each coaxial with a respective hole 226.

At the top, device 7 comprises a plurality of vertical tappet rods 233 moved axially by a fixed, vertical front cam (not shown for simplicity) along which rods 233 are moved forward by wall 219 with which rods 233 are angularly integral. Each rod 233 is coaxial with a respective hole 228.

At the bottom, device 7 comprises a plurality of vertical tappet rods 234 arranged evenly around wall 219 and moved axially by a fixed, vertical front cam (not shown for simplicity). Rods 234 are coaxial with respective rods 233 and, like the latter, are angularly integral with wall 219. For this purpose, a bottom portion 235 of each rod 234 engages, in a slidable manner, a respective hole 232. Each rod 234 comprises a top portion 236 designed to engage, in a slidable manner, a respective hole 226 and a respective cylinder 17.

Plant 1 operates as follows:

Capsules 3 are fed in bulk into rotary feedbox 23, rotation of which, as already mentioned, causes sleeves 31 to move back and forth as a result of respective rods 33 sliding along cam 29.

In the bottom dead center position, the top end of each sleeve 31 is located on a level with the bottom of feedbox 23, where capsules 3 can be withdrawn and dropped in single file inside the inner duct onto a known stop device not shown but described in a pending application by the present Applicant.

When a sleeve 31 containing capsules 3 reaches its bottom dead center position, the stop device is opened so as to cause capsule 3 to drop down into section 77 or slot 75 facing the sleeve 31.

Blades 89 and 90 and appendix 92 then cooperate, in known manner, with the capsule 3 to ensure it is positioned with bottom 5 facing downwards.

At this stage, on known feeding devices, each capsule 3 is fed straight into a respective cylinder 17 on conveying member 6. On feeding device 2 of plant 1, on the other hand, each capsule 3 is fed along a respective groove 84 so as to engage only partially, with bottom 5, a respective cylinder 17. Once in this position, each capsule 3 is supported axially, not by the respective cylinder 17, but by coupling 73 to which the top 4 of the capsule 3 remains attached following the vacuum created through the respective hole 85.

When capsule 3 moves past duct 93, located at point C, a vacuum is formed inside the respective cylinder 17 so as to separate bottom 5 from top 4 and drop bottom 5 into cylinder 17.

In other words, feeding device 2 differs from similar known feeding devices by comprising a device for separating bottoms 5 from respective tops 4. This separating device, consisting of holes 85 and duct 93, enables bottoms 5 to be carried off on conveying member 6, whereas the respective tops 4 are left inside grooves 84 as far as tangent point A between coupling 73 and annular element 136 on parking device 8.

Together with tubular element 53, bush 52 and holes 55, 56, 58, 61, 62, 63, 66 and 67, duct 57 constitutes a sorting system, already described in a pending application by the present Applicant and designed to enable faulty capsules 3 to be expelled from sleeves 31.

As already explained, tops 4 taken off respective bottoms 5 are fed forward anticlockwise around device 2 from point C to point A where they are fed into one out of every two slots 138 on annular element 136. As already explained, this is made possible by the center distance of slots 84 being twice that of slots 138.

The way in which tops 4 are transferred from slots 84 to slots 138 will not be described herein, for the sake of simplicity, in that it is common to a large number of automatic machines. Suffice it to say, in this connection, that, at point C, a fixed sector (not shown) inside element 32 intercepts holes 85 moving past it so as to cut off suction through holes 85 and so allow tops 4 to be sucked into respective slots 138 as a result of the vacuum formed inside them through respective holes 137.

Once housed inside respective slot 138, each top 4 is fed forward clockwise around device 8 by annular element 136. In more detail, each top 4 is fed forward from point A to point B where, instead of being fed to device 7, it is fed further forward, again round device 8, past point A and back to point B for the second time, where it is finally fed to device 7.

For a clearer understanding of how all this is achieved, a few comments should be made with reference to FIG. 6.

First of all, coupling 73 and annular elements 136 and 216 should be thought of as gears, since this is essentially what they become when tops 4 carried on them project radially outwards of respective slots 84, 138 and 217. When operated, these three gears 73, 136 and 216 move at the same speed, in that they are all called upon essentially to engage the same rack member consisting of conveying member 6.

Secondly, the number of "teeth" on gears 73 and 216 must be even; consequently, the number of "teeth" on gear 136 is odd. In other words, if 'n' is the number of slots 84 and 'n' the number of slots 84*a*, the total number of slots, or "teeth", on gear 73 is 2n, which cannot be other than even. The same applies to slots 217 and 217*a*, the total number of which is also 2n.

As for the "teeth" on gear 136, during operation each top 4 housed inside a slot 84 is transferred into a slot 138 and fed forward, inside the latter, from point A to point B where, to avoid being transferred onto gear 216, it must engage a slot 217*a* having no suction hole 221 and, consequently, empty. Continuing on gear 136 past point B, each top 4 passes once more through point A where, to avoid being crushed against a top 4 travelling towards point 4 on gear 86, it must engage an empty slot 84*a*. Moving on gear 136 past point A, each top comes back to point B where, if it is to be fed onto gear 216, it must engage a slot 217 provided with suction through respective hole 221.

This may only be achieved if the number of "teeth" on gear 136, i.e. the number of slots 138, is odd. To explain how each top 4 is only fed onto gear 216 the second time it passes through point B, we shall now examine annular elements 156 and 171, which are pneumatic distributors that will hereinafter be referred to respectively as "rotary" and "fixed" distributors.

Firstly, since as a vacuum exists inside chamber 176 which, when transmitted to slots 138, serves to hold tops 4 inside slots 138, whereas a pressure exists inside hole 178 which, when transmitted to slots 138, provides for transferring tops 4 from slots 138 to slots 217, fixed distributor 171 is located in such a manner that its hole 178 corresponds with point B to which the highest point on annular element 136 on disc 105 also corresponds. In fact, the only reason for the slope on element 136 on disc 105 is to allow the passage of appendix 227 between the same at point B.

As for rotary distributor 156, a distributor is selected with 'n' holes 162 and 'n' holes 163, so that the total number of axial through holes on rotary distributor 156 is 2n, i.e. the same number as the "teeth" on gears 73 and 216.

Since, as already explained, rotary distributor 156 turns at the same speed as gears 73 and 216, and since holes 162 and 163 communicate alternately with ducts 133 at the same frequency at which slots 217 and 217*a* come to face slots 138, the following initial setting, which is actually made at assembly, may be performed:

a top 4 is placed inside a slot 84 and coupling 73 is turned independently until this top 4 reaches point A;

annular element 136 is turned so as to bring a slot 138 up to point A and transfer this top 4 into the slot 138;

coupling 73 and annular element 136 are then turned in time so as to cause this top 4 to travel from A to B, B to A and A to B;

keeping coupling 73 and annular element 136 stationary, annular element 216 is turned until one of its slots 217 corresponds with point B and is ready to receive the top 4;

conveying member 6 is then assembled so as to link coupling 73 and annular elements 136 and 216, in such a way that, from now on, one rotation of any one of them is accompanied by timed rotation of the other two;

keeing annular element 136 stationary, the anglar position of fixed distributor 171 is adjusted, as stated, so that its hole 178 corresponds with point B; and, finally, still keeping annular element 136 stationary, the angular position of rotary distributor 156 is adjusted so as to align one of its holes 163 with hole 178, on one side, and, on the other side, with hole 135 relative to slot 138 previously arranged to correspond with point B and housing the top 4.

If now activated, plant 1 operates perfectly, i.e. the top 4, being held at point B, is transferred immediately into slot 217, brought up to face it, by compressed air being blown through holes 178, 163, 135, 133 and 137. Should a top 4 be present inside the next slot 138, this is fed forward towards point B which is reached simultaneously by top 4 and a slot 217*a* into which top 4 is not transferred, firstly, because the slot 217*a* is not provided with a suction hole 221 and, secondly, because rotary distributor 156 turns in time with annular element 216 and, when slot 138 containing the second top 4 reaches point B, moves into a position whereby one of its holes 162 communicates with hole 134 relative to slot 138 containing the second top 4, whereas none of holes 163 communicate with holes 178 and 135. Consequently, the second top 4 is held by suction inside respective slot 138.

Repeating the above concept for any tops 4 housed in subsequent slots 138, clearly, of the tops passing through point B, only one out of two is transferred into respective slot 217.

Operation of the fastening and knock-out device consisting of rods 233 and 234 is clearly illustrated in FIGS. 4 and 5 and the relative description and, therefore, requires no futher explanation.

In short, therefore, on plant 1, each capsule 3 is separated into its component parts, i.e. top 4 and bottom 5, inside the same feeding device 2 and, whereas bottom 5 is fed forward by conveying member 6 along a first route C-B extending through all the operating stations consisting of devices 11 to 15 and device 7, the respective top 4 is fed forward along a second route C-A, A-A, A-B, of exactly the same length as the first and defined by a parking device 8 which, by supporting tops 4 for more than one turn round its circumference, may be relatively small in size.

In connection with each top 4 and its respective bottom 5, it should be stated that they are joined at point B in the same mutual angular position in which they were separated at point C.

This feature is essentially the main achievement of plant 1, which is thus capable of handling capsules with writing on the sides, compulsory in many countries, extending over both the top and bottom of the capsule. As capsules 3 are fed in bulk into feeding device 2 with no possibility of controlling the location of the writing on the sides when capsules 3 reach slots 84, to ensure the writing on the top and bottom are kept in line, each top 4 must be put back, at point B, onto the bottom 5 from which it was removed at point C. Clearly, when handling plain capsules with no writing, a much simpler parking device than device 8 may be used, consisting solely, for example, of annular element 136. In this case, there would no longer by any need to join each top 4 to a specific respective bottom 5. Any top 4 could be joined to any bottom 5. In other words, the second route travelled by tops 4 would not necessarily need to be the same length as the first route travelled by bottoms 5. In fact, it could be of any length, even much shorter, the only disadvantage in this case being the rejection of a number of bottoms 5 when plant 1 is started up. Finally, it should be pointed out that, although in the example shown device 8 is located between device 2 and device 7 it may be located differently. In fact, operation would in no way be affected if capsules 3, instead of being separated at the output of device 2, were fed by the latter to conveying member 6 and were separated later, e.g. at device 11, in which case, device 8 would be located between devices 11 and 7.

I claim:

1. Plant for capsuling products, particularly pharmaceutical products, using capsules, each comprising a bottom, containing the product itself, and a removable top for closing the said bottom, characterized by the fact that it comprises, in due combination, means for separating each bottom from the respective top, operating stations comprising at least a station for feeding or metering the product to the inside of the said bottom and a station for closing the said bottom; first conveying means for feeding each said bottom along a given first route extending through the said operating stations; second conveying means for feeding each said top between the said separating means and the said closing station, along a given second route extending outside each side feeding or metering station, and fastening means at the said closing station for joining each said bottom to the respective said top and wherein the said first and second routes are of the same length, the said fastening means joining each said bottom to the respective said top; said second route comprises a closed loop; the said first conveying means comprise a closed-loop conveying member provided with an evenly-distributed succession of cavities, each designed to receive a respective said bottom, each said operating station comprising a rotary portion engaging, at least over part of its circumference, with the said conveying member; and the said second conveying means comprise a rotary input member having a number of first peripheral recesses for the said tops, a rotary parking member tangent with the said rotary input member at an input point and having a number of second peripheral recesses for the said tops, and a rotary output member tangent with the said rotary parking member at an output point and having a number of third peripheral recesses for the said tops; and pneumatic holding means for the said tops communicating with each of the said first, second and third recesses.

2. Plant according to claim 1, characterized by the fact that the said rotary parking member defines the said loop of the said second route.

3. Plant according to claim 2, characterized by the fact that the said rotary input member presents a number of first false peripheral recesses for the said tops, the said recesses alternating with the said first recesses; the said rotary output member having a number of second false recesses for the said tops, the said recesses alternating with the said third recesses, the center distance of the said second recesses on the said rotary parking member being equal both to the center distance between each said first recess and an adjacent said first false recess and between each said third recess and an adjacent said second false recess, and to half the center distance between each pair of the said adjacent cavities on the said loop conveyor, the said second recesses being odd in number and actuating means being provided for turning, in concordant manner, the said rotary input and output members and, in discordant manner, the said rotary parking member, at the same speeds and timed in relation to one another.

4. Plant according to claim 3, characterized by the fact that the said rotary input member cooperates with the said means for separating each said bottom from its respective said top.

5. Plant according to claim 3, characterized by the fact that the said rotary output member forms part of the said closing station.

6. Plant according to claim 3, characterized by the fact that the said second conveying means also comprise means for transferring in succession from the said rotary parking member to the said rotary output member, at the said output point, one out of every two tops fed foward to the said output point by the said rotary parking member.

7. Plant according to claim 6, characterized by the fact that the said transfer means comprise pneumatic knock-out means and distributing means cooperating with the said rotary parking member so as to arrange the said second recesses, as they pass through the said output point, successively and alternately in communication with the said pneumatic holding means and with the said pneumatic knock-out means.

* * * * *